US007236150B2

(12) United States Patent
Hui

(10) Patent No.: US 7,236,150 B2
(45) Date of Patent: Jun. 26, 2007

(54) TRANSFERRING DATA DIRECTLY BETWEEN A PROCESSOR AND A SPATIAL LIGHT MODULATOR

(75) Inventor: Sue Hui, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 550 days.

(21) Appl. No.: 10/741,249

(22) Filed: Dec. 19, 2003

(65) Prior Publication Data

US 2005/0134613 A1 Jun. 23, 2005

(51) Int. Cl.
*G09G 3/36* (2006.01)

(52) U.S. Cl. ..... 345/87; 345/100

(58) Field of Classification Search ..... 345/4–6, 345/63, 84, 83, 87, 88, 90–100, 204; 348/180, 348/190, 745, 755, 770, 771, 806; 353/31; 359/53; 349/33; 365/189.05
See application file for complete search history.

(56) References Cited

U.S. PATENT DOCUMENTS 5,729,245 A * 3/1998 Gove et al. ..... 345/84
6,107,979 A * 8/2000 Chiu et al. ..... 345/84
6,281,861 B1 * 8/2001 Harrold ..... 345/32
6,741,503 B1 * 5/2004 Farris et al. ..... 365/189.05
2003/0142274 A1 * 7/2003 Gibbon et al. ..... 353/31
2003/0156083 A1 * 8/2003 Willis ..... 345/84
2003/0174234 A1 * 9/2003 Kondo et al. ..... 348/362

OTHER PUBLICATIONS

"Who Says You Can't Be Cutting-Edge and Tried and True?, The only all-digital display solution"; http://www.dlp.com/dlp_technology/dlp_technology_overview.asp.
Yoder, Lars A., et al.; "An Introduction to the Digital Light Processing (DLP™) Technology".
Pyne, Marc, et al.; "DLP™ and Digital Interfaces: The Complete Digital Solution"; DLP™ A Texas Instruments Technology; Jul. 10, 1999.
Duncan, Walter, et al.; "DLP™ Switched Blaze Grating; the Heart of Optical Signal Processing"; SPIE Proceedings, vol. 4983; © 2003 Society of Photo-Optical Instrumentation Engineers.

* cited by examiner

*Primary Examiner*—Nitin I. Patel
(74) *Attorney, Agent, or Firm*—Dawn V. Stephens; W. James Brady, III; Frederick J. Telecky, Jr.

(57) ABSTRACT

A method of loading data into a spatial light modulator, in which a software programmable processor stores binary values for the pixels of at least a portion of the (x,y) array of a spatial light modulator. The processor stores these values in its addressable memory, and accesses them by calculating bit positions in memory words (elements), as a function of x and y and other parameters of the processor and spatial light modulator. The same concepts may be applied to reading data out of a spatial light modulator.

24 Claims, 4 Drawing Sheets

TRANSFERRING DATA DIRECTLY BETWEEN A PROCESSOR AND A SPATIAL LIGHT MODULATOR

TECHNICAL FIELD

This invention relates generally to the field of spatial light modulators and more specifically to loading data into (or reading data from) a spatial light modulator.

BACKGROUND OF THE DISCLOSURE

One type of spatial light modulator (SLM) is a Digital Micromirror Device (DMD), an microelectromechanical system (MEMS) device that operates as a reflective digital light switch. A DMD may be used in a variety of applications. As an example, a DMD may be used in an imaging system such as a digital light processing (DLP™) system for projecting images. In an imaging system, pre-recorded data is typically loaded into the DMD. As another example, a DMD may be used in an optical networking system to process, for example, wavelength division multiplexed (WDM) light signals. In an optical switching system, a pattern to be loaded into the DMD is typically locally generated and may be frequently updated.

Different applications present different requirements on how data is processed and loaded into the DMD. Known techniques for loading data into a DMD include using either an application specific integrated circuit (ASIC) or a field programmable gate array (FPGA) device to load data into the DMD. These known techniques, however, may be inefficient in some circumstances.

SUMMARY OF THE DISCLOSURE

According to one embodiment of the present invention, loading data into a spatial light modulator includes storing in the addressable memory of one or more processors, binary values for at least a portion of a pixel array of a spatial light modulator. The processor accesses the binary values, using an algorithm that maps each binary value to the kth position in the jth word of the processor's addressable memory. The processor calculates the j and k values as functions of the following: the (x,y) coordinate values of the pixel array, the processor's internal word size, and the ratio of the number of elements in the pixel array to the width of the data bus between the spatial light modulator and the processor. The processor then directly loads the binary values to the spatial light modulator.

A technical advantage of the above-described embodiment is that data may be loaded directly from a processor into the SLM. The processor is programmed to load data by associating a bit of a word in the addressable memory to a pixel of an array of the spatial light modulator. Accordingly, the processor may comprise a commercial off-the-shelf programmable processor rather than a hardware implementation such ASIC or FPGA devices that may require customization.

Certain embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION OF THE DRAWINGS

Embodiments of the present invention and its advantages are best understood by referring to FIGS. 1 through 5 of the drawings, like numerals being used for like and corresponding parts of the various drawings.

Figure 1:
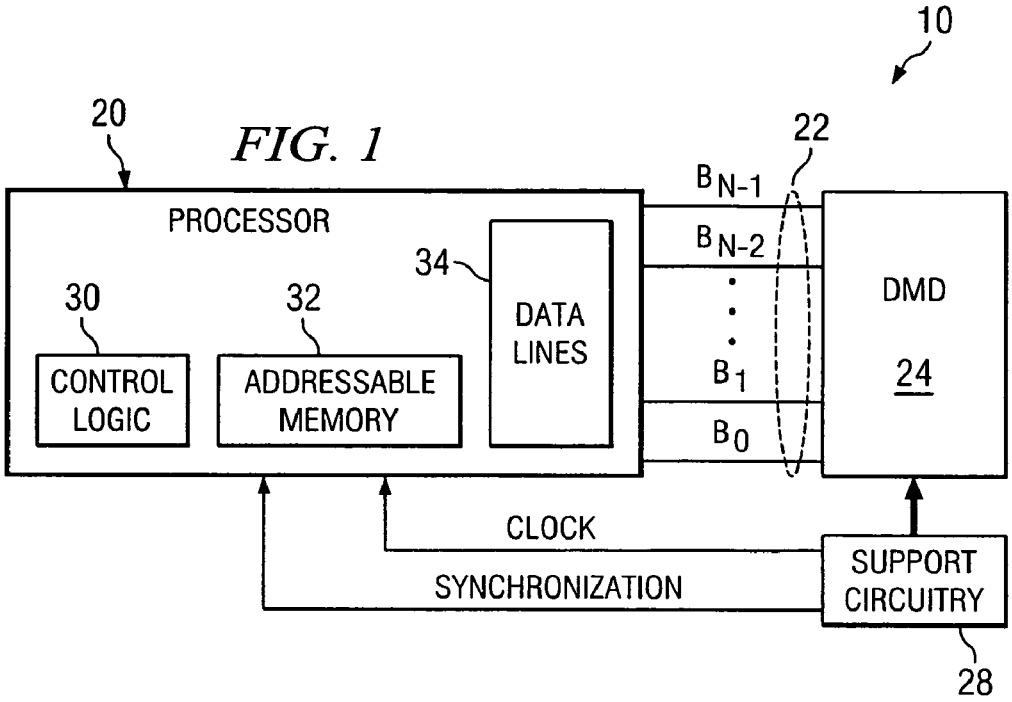
FIG. 1 is a block diagram illustrating one embodiment of a system that includes a processor that loads data directly into a DMD.

FIG. 1 is a block diagram illustrating one embodiment of a system 10 that includes a processor that loads data directly into a spatial light modulator. The processor may be programmed to load data by associating each kth bit of a jth word in an addressable memory to a pixel value, z(x,y), of an array of the spatial light modulator. Accordingly, the processor may comprise a commercial off-the-shelf programmable processor rather than hardware implementations such ASIC or FPGA devices that may require customization.

For purposes of example herein, the processor loads data directly into a digital micromirror device (DMD) type SLM. The processor may also be used to load data into other types of SLMs, such as a liquid-crystal display (LCD) or plasma-based display.

Although the following description is mostly in terms of loading data to an SLM, the same concepts may be applied to reading data out of an SLM. The data is transferred from the SLM to the processor's addressable memory, using the same associations of z(x,y) to a kth bit of a jth word, as described herein.

According to the illustrated embodiment, system 10 includes a processor 20, an N-bit bus interface 22, a digital micromirror device 24, and support circuitry 28 coupled as shown. According to one embodiment of operation, processor 20 generates a data array that instructs DMD 24 to produce a specific pattern. DMD 24 produces the pattern by tilting micromirrors to reflect light according to the pattern.

Processor 20 is programmed to load data by associating a bit of a word in an addressable memory to a pixel of an array of the spatial light modulator. Accordingly, the processor may comprise a commercial off-the-shelf programmable processor rather than a hardware implementation such ASIC or FPGA devices that may require customization. As used in this document, "processor" may comprise any suitable processor having a CPU, programmable software, and internal or external addressable memory. As an example, processor 20 may comprise an embedded processor such as a processor of the TMS 320C64x family of processors manufactured by TEXAS INSTRUMENTS, INC.

Processor 20 may include control logic 30, an addressable memory 32, and data lines 34. Control logic 30 controls the operation of processor 20. Addressable memory 32 stores the data array. Data lines 34 transmit the data array from addressable memory 32 to interface 22. In read operations, data lines 34 receive the data array from interface 22 and stores the data in the addressable memory 32.

According to one embodiment, processor 20 may synchronize data output to DMD 24. Processor 20 may operate as either a master that initiates the transfer of data or a slave that starts the transfer of data after receiving an external request. For illustration purposes only, processor 20 is shown as operating as a slave. When DMD 24 is ready to receive data, support circuitry 28 sends a synchronization signal to processor 20. In response, processor 20 starts the transfer of data. There may be a small but fixed amount of delay from the time processor 20 receives the synchronization signal to the time the data is transferred to interface 22. As an example, processor 20 may have direct memory access capabilities to synchronize and transfer data.

Processor 20 may operate to provide continuous data transfer at a rate governed by DMD 24, and may control the amount of data transferred to provide either a complete or partial image. Interface 22 transfers data from processor 20 to DMD 24, and may comprise a N-bit bus interface that is directly coupled to the inputs of DMD 24.

DMD 24 reflects light according to a pattern. DMD 24 includes a mirror array that constitutes pixels, where each pixel comprises a structure that is operable to reflect light at a certain angle in response to digital instructions. As an example, a mirror array may comprise hundreds or thousands of rows and columns of pixels.

A pixel may have any suitable configuration. According to one embodiment, a pixel may comprise a monolithically integrated MEMS superstructure cell fabricated over a memory cell such as a static random access memory (SRAM) cell.

Support circuitry 28 provides control signals to processor 20 and DMD 24. As an example, support circuitry 28 provides a clock signal and a synchronization signal to processor 20. The synchronization signal may be used to interrupt processor 20 and initiate and synchronize data transfer.

Alterations or permutations such as modifications, additions, or omissions may be made to system 10 without departing from the scope of the invention. System 10 may have more, fewer, or other modules. Moreover, the operations of system 10 may be performed by more, fewer, or other modules. For example, the operations of processor 20 and support circuitry 28 may be performed by one module, or the operations of processor 20 may be performed by more than one processor 20. Additionally, operations of system 20 may be performed using any suitable logic comprising software, hardware, other logic, or any suitable combination of the preceding. As used in this document, "each" refers to each member of a set or each member of a subset of a set.

Figure 2:
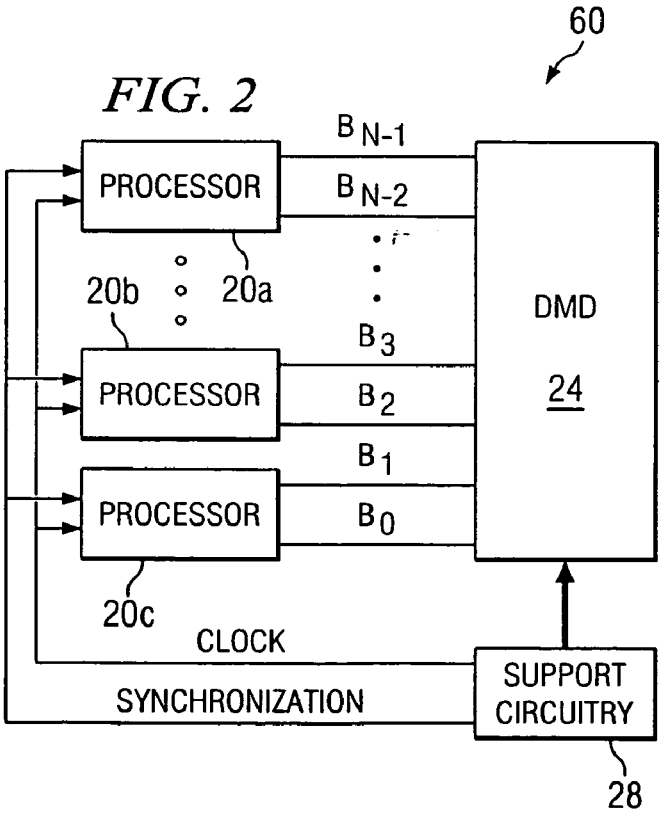
FIG. 2 is a block diagram illustrating one embodiment of a system that includes multiple processors that load data directly into a DMD.

FIG. 2 is a block diagram illustrating one embodiment of a system 60 that includes multiple processors 20 that load data directly into DMD 24. Although system 60 is illustrated with three processors 20*a–c*, system 60 may include any suitable number of processors 20. Support circuitry 28 may coordinate processors 20 to load data directly into DMD 24.

Figure 3:
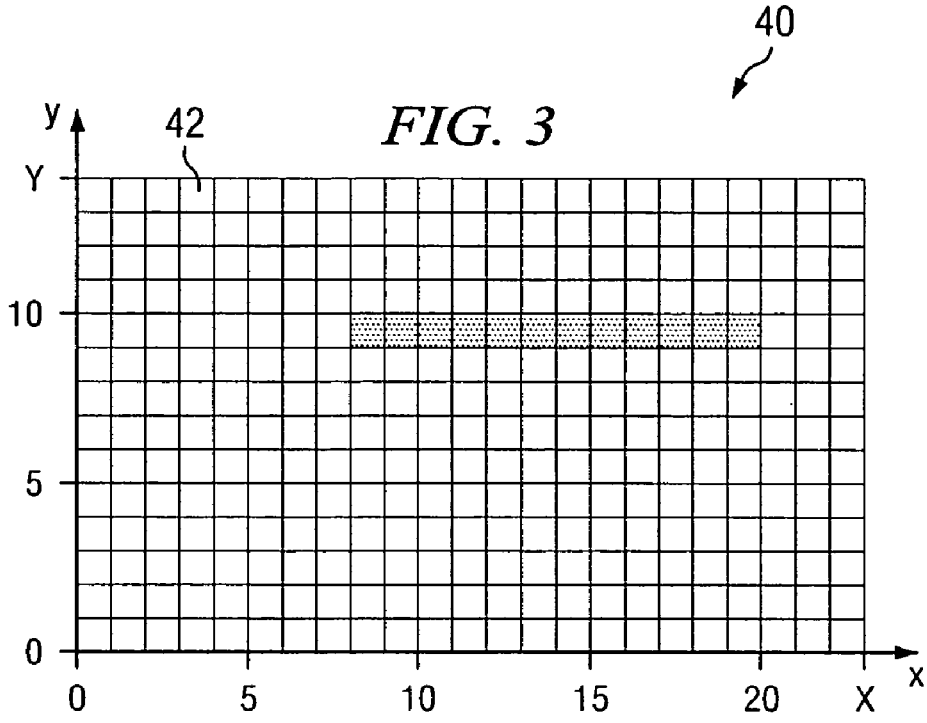
FIG. 3 illustrates a portion of one embodiment of a mirror array of a DMD.

FIG. 3 illustrates a portion 40 of one embodiment of a mirror array of DMD 24 that includes pixels 42. Variable x represents location along an x-axis corresponding to a row of portion 40. Variable y represents location along a y-axis corresponding to a column of portion 40. Accordingly, a pixel 42 may be described as having a location (x,y). Parameter X represents the number of columns of portion 40, and parameter Y represents the number of rows of portion 40. The mirrors of pixels 42 may be tilted at different angles according to a pattern. According to the illustrated embodiment, mirrors at pixels $\{x: 8 \leqq x \leqq 15, y=10\}$ are tilted in one direction and the mirrors of the other pixels are tilted in another direction.

Alterations or permutations such as modifications, additions, or omissions may be made to portion 40 without departing from the scope of the invention. Portion 40 may have more or fewer pixels 42 arranged in any suitable configuration.

Figure 4:
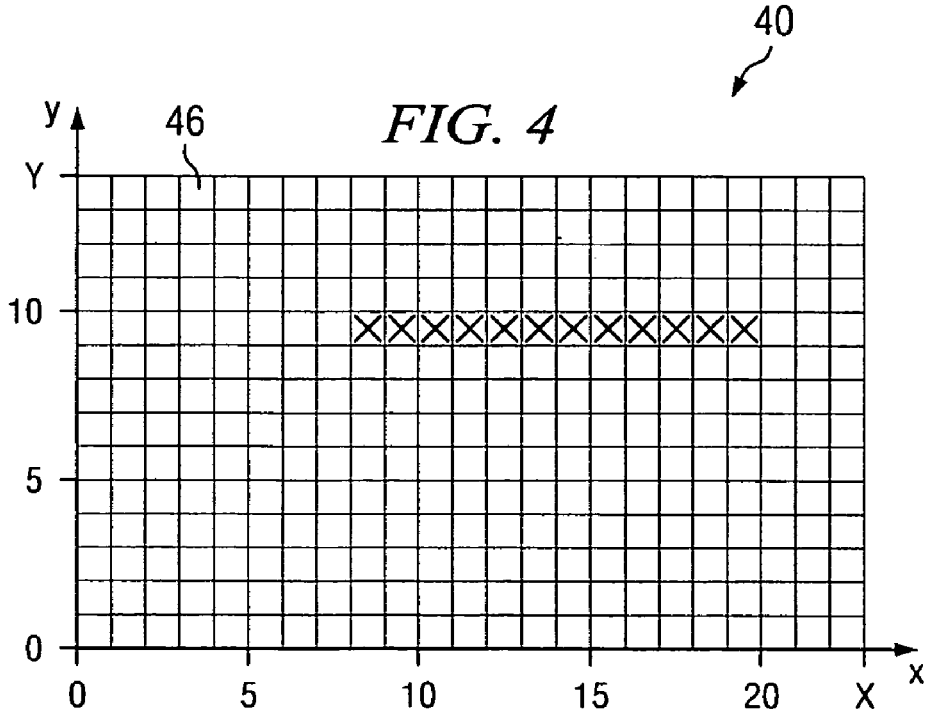
FIG. 4 illustrates example memory cells corresponding to the portion of the mirror array of FIG. 3.

FIG. 4 illustrates example memory cells 46 of portion 40 of the mirror array of FIG. 3. Memory cells 46 may be used to store the pattern for the mirror array. A pattern may include patterns values, where each pattern value is used to control the tilt of the mirror of a corresponding pixel 42. As an example, a pattern value of one may cause a mirror to tilt in one direction, while a pattern value of zero may cause the mirror to tilt in another direction. Each memory cell 46 may store a pattern value.

A pattern value z for a pixel 42 at location (x, y) may be expressed using a function z=f(x,y). According to the illustrated example, the pattern stored at memory cells 46 may be expressed as z=1 for $(x: 8 \leqq x \leqq 15, y=10)$, and z=0 otherwise. These pattern values may yield the pattern of FIG. 2.

Alterations or permutations such as modifications, additions, or omissions may be made to memory cells 46 without departing from the scope of the invention. Memory cells 46 may have more or fewer memory cells.

Figure 5:
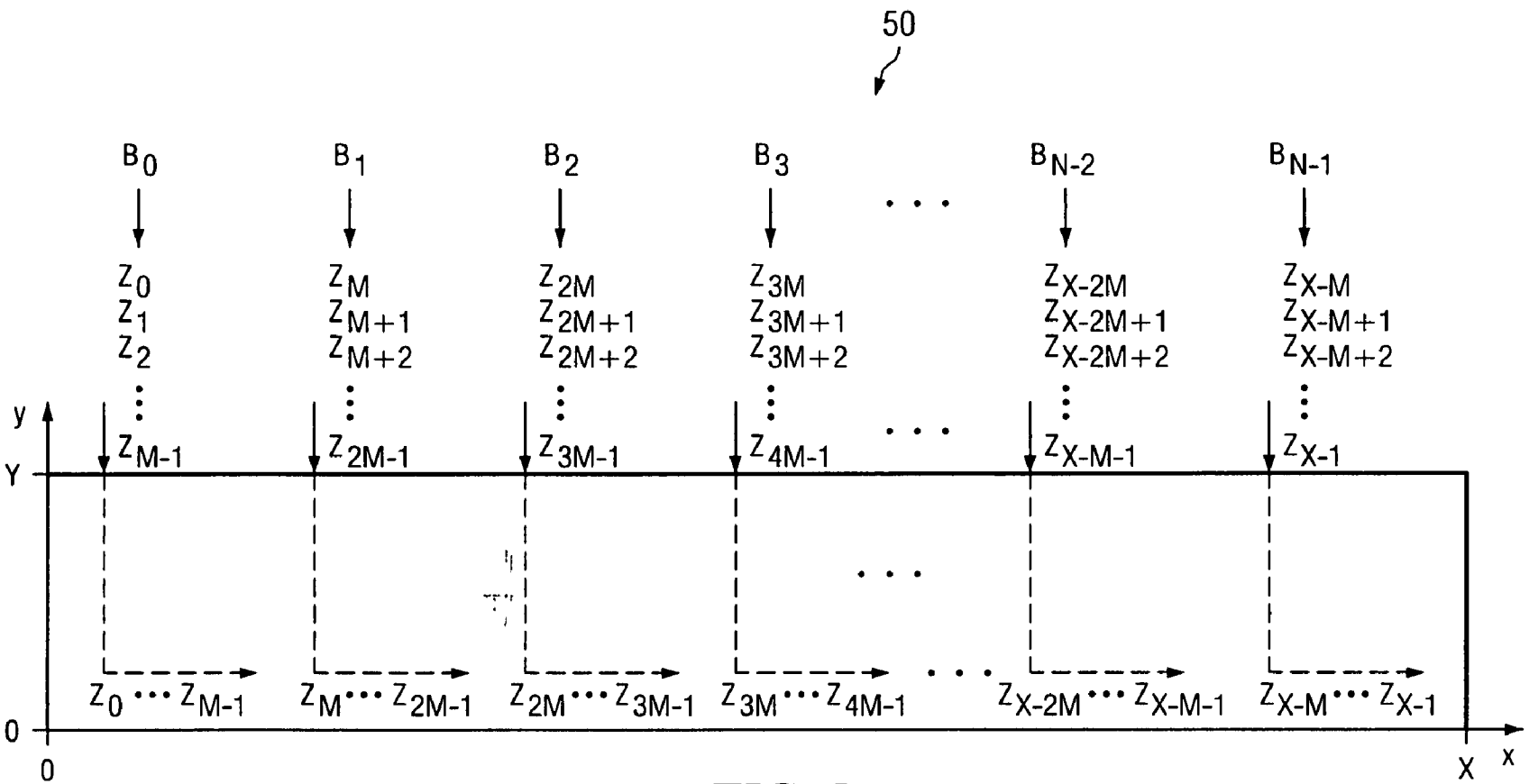
FIG. 5 is a diagram illustrating one embodiment of a process of sending data to a DMD.

FIG. 5 is a diagram 50 illustrating one embodiment of a process for sending data to DMD 24. According to the illustrated embodiment, N represents the number of data lines of DMD 24, and $B_i$ represents a bus for a data line i of DMD 24. The data includes pattern values $Z_k$, k=0, 1, . . . , X−1, for a row, where parameter X represents the number of pixels in a row. The X pattern values are divided into N groups, where each group includes M=X/N pattern values. A group of M pattern values is serially input into one of the N data lines. If the data lines simultaneously shift data into DMD 24, a row of data may be filled after M clock cycles.

Figure 6:
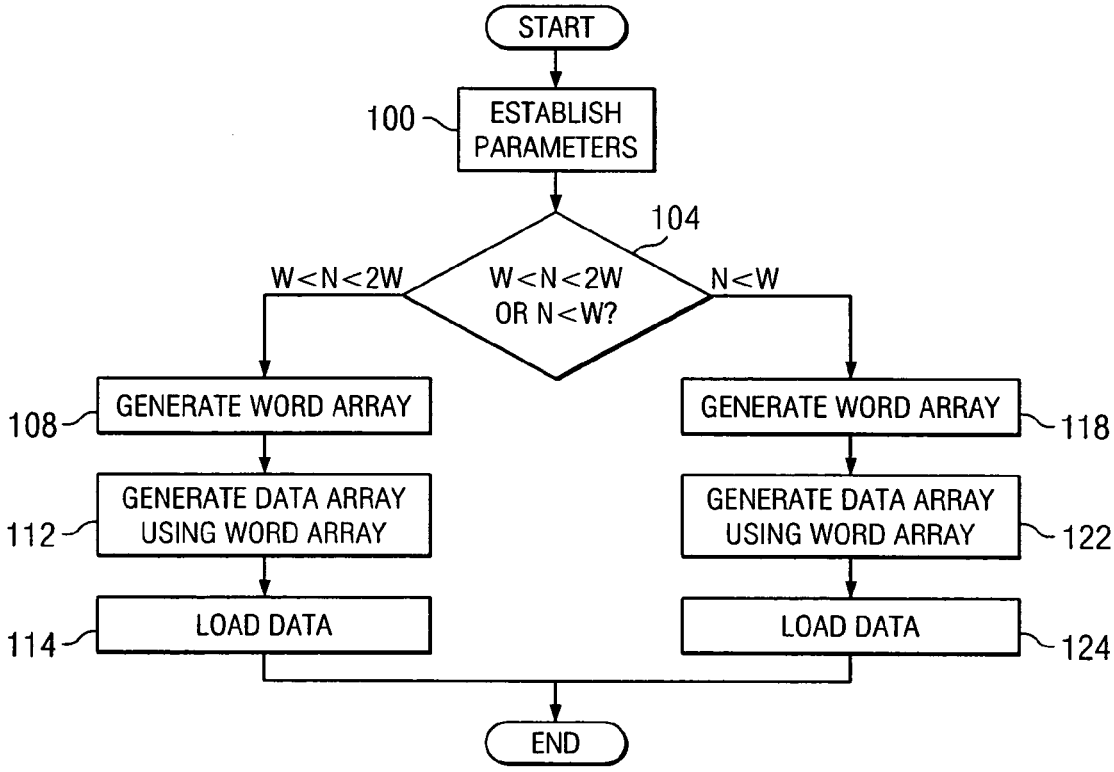
FIG. 6 is a flowchart illustrating one embodiment of a method for loading data into a DMD.

FIG. 6 is a flowchart illustrating one embodiment of a method for loading data into DMD 24. The method begins at step 100, where the system parameters are established. According to one embodiment, DMD 24 has N data lines and a mirror array with X pixels per row and Y pixels per column. One or more processors 20 have L data lines, where L may be greater than or equal to N. One or more processors 20 also have an internal data width W. A pattern value of a pattern for a pixel at (x,y) may be given by function $z_{x,y}=f(x,y)$. The number X is divisible by N, and the number of pattern values for each loading group is M=X/N.

Steps 108, 113, 118, and 122 illustrate creation of a data array that may be loaded into DMD 24. The data array includes entries that instruct pixels 42 to form a specific pattern. Each entry may be used to record a pattern value for a pixel 42 corresponding to the entry. As an example, the data array comprises a single memory array WbitSingleDataArray[size], or A[size], that includes the bit information for DMD 24. Each entry of the array has a width of W, so the size of the array is (X*Y)/W. Bit position k of each entry of the array may be described using:

| W-1 | W-2 | 1 | 0 | ← | k |
|---|---|---|---|---|---|
| bitW-1 | bitW-2 | bit1 | bit0 | ← | bits in each entry |

According to one embodiment, a word array may be used. As an example, a word array may comprise a single array bitMask[W] of width W with W entries. The bitMask[W] may be defined to include words, where each word has one bit set in one unique position starting from the least significant bit to the most significant bit.

If the number of data lines N of DMD 24 is greater than data memory width W of processor 20 but less than or equal to 2*W at step 104, the method proceeds to step 108. A word array is generated at step 108. As an example, a word array comprising bitMask[W=32] may be defined according to Equation (1):

$$\begin{aligned} bitMask[32] = \{&0\times00000001, 0\times00000002, 0\times00000004, 0\times00000008,\\ &0\times00000010, 0\times00000020, 0\times00000040, 0\times00000080,\\ &0\times00000100, 0\times00000200, 0\times00000400, 0\times00000800,\\ &0\times00001000, 0\times00002000, 0\times00004000, 0\times00008000,\\ &0\times00010000, 0\times00020000, 0\times00040000, 0\times00080000,\\ &0\times00100000, 0\times00200000, 0\times00400000, 0\times00800000,\\ &0\times01000000, 0\times02000000, 0\times04000000, 0\times08000000,\\ &0\times10000000, 0\times20000000, 0\times40000000, 0\times80000000\} \end{aligned} \tag{1}$$

As another example, bitMask[W=16] may be defined according to Equation (2):

$$\begin{aligned} bitMask[16] = \{&0\times0001, 0\times0002, 0\times0004, 0\times0008,\\ &0\times0010, 0\times0020, 0\times0040, 0\times0080,\\ &0\times0100, 0\times0200, 0\times0400, 0\times0800,\\ &0\times1000, 0\times2000, 0\times4000, 0\times8000\} \end{aligned} \tag{2}$$

A data array is generated at step 112. As an example, a data array comprising A[X*Y/W] may be generated. For a given pixel at location (x,y), the pattern value $Z_{x,y}$=f(x,y) of the pixel corresponds to a bit k of element j of A[X*Y/W]. An "element" of the addressable memory may also be referred to as a "word". The values of k and j may be determined by Equations (3) and (4):

$$j=2*M*y+2*(M-1-|x|_M)+[x/(W*M)] \tag{3}$$

$$k=|[x/M]|_W \tag{4}$$

where "*" represents a multiply operation, for example, 32*2=64; "/" represents a division operation, for example, 32/16=2; "$|.|_M$" represents a modulo M operation, for example, $|2|_6=2$, $|18|_{16}=2$; and "[.]" represents a truncation operation, for example, [1/16]=[0.0625]=0 and [17/16]=[1.0625]=1.

A data array for a specific pattern may be generated by updating each entry to record the pattern values. For example, if $Z_{x,y}$=0, bit k in element j may be updated according to Equation (5):

$$A[j]=A[j]\ \&(\sim\text{bitMask}[k]) \tag{5}$$

and if $Z_{x,y}$=1, bit k in element j may be updated according to Equation (6):

$$A[j]=A[j]|\text{bitMask}[k] \tag{6}$$

where "~" represents a bitwise negation operation, for example, if 4-bit data B=1010, then ~B=0101; "&" represents a bitwise AND operation, for example, if 4-bit data $B_1$=1011 and $B_2$=1101, then $B_1\&B_2$=1001; and "|" represents a bitwise OR operation, for example, if 4-bit data $B_1$=1011 and $B_2$=1101, then $B_1|B_2$=1111.

In a first example, the number of pixels of one row X=1024, number of pixels of one column Y=768, number of processor data lines L=number of DMD data lines N=64, and processor internal data width W=32. The number of pattern values per group M=X/N=1024/64=16. The pattern may be described by Equation (7):

$$z_{x,y} = \begin{cases} 1, \text{ for } x = 2n,\ y = 0,\ n = 0, 1, \ldots, 511 \\ 1, \text{ for } x = 2n+1,\ y = 1,\ n = 0, 1, \ldots, 511 \\ 1, \text{ for all other } x \text{ and } y \end{cases} \tag{7}$$

The corresponding element j and bit k of the A[X*Y/W] for each (x,y) may be given by Equations (8):

$$
\begin{aligned}
A[1] &= [00000000\ 00000000\ 00000000\ 00000000] & A[0] &= [00000000\ 00000000\ 00000000\ 00000000] \\
A[3] &= [11111111\ 11111111\ 11111111\ 11111111] & A[2] &= [11111111\ 11111111\ 11111111\ 11111111] \\
A[5] &= [00000000\ 00000000\ 00000000\ 00000000] & A[4] &= [00000000\ 00000000\ 00000000\ 00000000] \\
A[7] &= [11111111\ 11111111\ 11111111\ 11111111] & A[6] &= [11111111\ 11111111\ 11111111\ 11111111] \\
A[9] &= [00000000\ 00000000\ 00000000\ 00000000] & A[8] &= [00000000\ 00000000\ 00000000\ 00000000] \\
A[11] &= [11111111\ 11111111\ 11111111\ 11111111] & A[10] &= [11111111\ 11111111\ 11111111\ 11111111] \\
A[13] &= [00000000\ 00000000\ 00000000\ 00000000] & A[12] &= [00000000\ 00000000\ 00000000\ 00000000] \\
A[15] &= [11111111\ 11111111\ 11111111\ 11111111] & A[14] &= [11111111\ 11111111\ 11111111\ 11111111] \\
A[17] &= [00000000\ 00000000\ 00000000\ 00000000] & A[16] &= [00000000\ 00000000\ 00000000\ 00000000] \\
A[19] &= [11111111\ 11111111\ 11111111\ 11111111] & A[18] &= [11111111\ 11111111\ 11111111\ 11111111] \\
A[21] &= [00000000\ 00000000\ 00000000\ 00000000] & A[20] &= [00000000\ 00000000\ 00000000\ 00000000] \\
A[23] &= [11111111\ 11111111\ 11111111\ 11111111] & A[22] &= [11111111\ 11111111\ 11111111\ 11111111] \\
A[25] &= [00000000\ 00000000\ 00000000\ 00000000] & A[24] &= [00000000\ 00000000\ 00000000\ 00000000] \\
A[27] &= [11111111\ 11111111\ 11111111\ 11111111] & A[26] &= [11111111\ 11111111\ 11111111\ 11111111] \\
A[29] &= [00000000\ 00000000\ 00000000\ 00000000] & A[28] &= [00000000\ 00000000\ 00000000\ 00000000] \\
A[31] &= [11111111\ 11111111\ 11111111\ 11111111] & A[30] &= [11111111\ 11111111\ 11111111\ 11111111] \\
A[33] &= [11111111\ 11111111\ 11111111\ 11111111] & A[32] &= [11111111\ 11111111\ 11111111\ 11111111] \\
A[35] &= [00000000\ 00000000\ 00000000\ 00000000] & A[34] &= [00000000\ 00000000\ 00000000\ 00000000] \\
A[37] &= [11111111\ 11111111\ 11111111\ 11111111] & A[36] &= [11111111\ 11111111\ 11111111\ 11111111] \\
A[39] &= [00000000\ 00000000\ 00000000\ 00000000] & A[38] &= [00000000\ 00000000\ 00000000\ 00000000] \\
A[41] &= [11111111\ 11111111\ 11111111\ 11111111] & A[40] &= [11111111\ 11111111\ 11111111\ 11111111] \\
A[43] &= [00000000\ 00000000\ 00000000\ 00000000] & A[42] &= [00000000\ 00000000\ 00000000\ 00000000] \\
A[45] &= [11111111\ 11111111\ 11111111\ 11111111] & A[44] &= [11111111\ 11111111\ 11111111\ 11111111] \\
A[47] &= [00000000\ 00000000\ 00000000\ 00000000] & A[46] &= [00000000\ 00000000\ 00000000\ 00000000] \\
A[49] &= [11111111\ 11111111\ 11111111\ 11111111] & A[48] &= [11111111\ 11111111\ 11111111\ 11111111] \\
A[51] &= [00000000\ 00000000\ 00000000\ 00000000] & A[50] &= [00000000\ 00000000\ 00000000\ 00000000] \\
A[53] &= [11111111\ 11111111\ 11111111\ 11111111] & A[52] &= [11111111\ 11111111\ 11111111\ 11111111] \\
A[55] &= [00000000\ 00000000\ 00000000\ 00000000] & A[54] &= [00000000\ 00000000\ 00000000\ 00000000] \\
A[57] &= [11111111\ 11111111\ 11111111\ 11111111] & A[56] &= [11111111\ 11111111\ 11111111\ 11111111] \\
A[59] &= [00000000\ 00000000\ 00000000\ 00000000] & A[58] &= [00000000\ 00000000\ 00000000\ 00000000] \\
A[61] &= [11111111\ 11111111\ 11111111\ 11111111] & A[60] &= [11111111\ 11111111\ 11111111\ 11111111] \\
A[63] &= [00000000\ 00000000\ 00000000\ 00000000] & A[62] &= [00000000\ 00000000\ 00000000\ 00000000] \\
A[65] &= [00000000\ 00000000\ 00000000\ 00000000] & A[64] &= [00000000\ 00000000\ 00000000\ 00000000] \\
A[67] &= [00000000\ 00000000\ 00000000\ 00000000] & A[66] &= [00000000\ 00000000\ 00000000\ 00000000] \\
&\vdots
\end{aligned}
\tag{8}
$$

In a second example, the number of pixels of one row X=800, number of pixels of one column Y=600, number of processor data lines L=64, number of DMD data lines N=50, and processor internal data width W=32. The number of pattern values per group M=X/N=800/50=16. The pattern may be described by Equation (7).

The corresponding element j and bit k of the A[X*Y/W] for each (x,y) may be given by Equations (9):

$$
\begin{aligned}
A[1] &= [xxxxxxxx\ xxxxxx00\ 00000000\ 00000000] & A[0] &= [00000000\ 00000000\ 00000000\ 00000000] \\
A[3] &= [xxxxxxxx\ xxxxxx11\ 11111111\ 11111111] & A[2] &= [11111111\ 11111111\ 11111111\ 11111111] \\
A[5] &= [xxxxxxxx\ xxxxxx00\ 00000000\ 00000000] & A[4] &= [00000000\ 00000000\ 00000000\ 00000000] \\
A[7] &= [xxxxxxxx\ xxxxxx11\ 11111111\ 11111111] & A[6] &= [11111111\ 11111111\ 11111111\ 11111111]
\end{aligned}
\tag{9}
$$

-continued $A[9] = [xxxxxxxx\ xxxxxx00\ 00000000\ 00000000]$ $A[8] = [00000000\ 00000000\ 00000000\ 00000000]$ $A[11] = [xxxxxxxx\ xxxxxx11\ 11111111\ 11111111]$ $A[10] = [11111111\ 11111111\ 11111111\ 11111111]$ $A[13] = [xxxxxxxx\ xxxxxx00\ 00000000\ 00000000]$ $A[12] = [00000000\ 00000000\ 00000000\ 00000000]$ $A[15] = [xxxxxxxx\ xxxxxx11\ 11111111\ 11111111]$ $A[14] = [11111111\ 11111111\ 11111111\ 11111111]$ $A[17] = [xxxxxxxx\ xxxxxx00\ 00000000\ 00000000]$ $A[16] = [00000000\ 00000000\ 00000000\ 00000000]$ $A[19] = [xxxxxxxx\ xxxxxx11\ 11111111\ 11111111]$ $A[18] = [11111111\ 11111111\ 11111111\ 11111111]$ $A[21] = [xxxxxxxx\ xxxxxx00\ 00000000\ 00000000]$ $A[20] = [00000000\ 00000000\ 00000000\ 00000000]$ $A[23] = [xxxxxxxx\ xxxxxx11\ 11111111\ 11111111]$ $A[22] = [11111111\ 11111111\ 11111111\ 11111111]$ $A[25] = [xxxxxxxx\ xxxxxx00\ 00000000\ 00000000]$ $A[24] = [00000000\ 00000000\ 00000000\ 00000000]$ $A[27] = [xxxxxxxx\ xxxxxx11\ 11111111\ 11111111]$ $A[26] = [11111111\ 11111111\ 11111111\ 11111111]$ $A[29] = [xxxxxxxx\ xxxxxx00\ 00000000\ 00000000]$ $A[28] = [00000000\ 00000000\ 00000000\ 00000000]$ $A[31] = [xxxxxxxx\ xxxxxx11\ 11111111\ 11111111]$ $A[30] = [11111111\ 11111111\ 11111111\ 11111111]$ $A[33] = [xxxxxxxx\ xxxxxx11\ 11111111\ 11111111]$ $A[32] = [11111111\ 11111111\ 11111111\ 11111111]$ $A[35] = [xxxxxxxx\ xxxxxx00\ 00000000\ 00000000]$ $A[34] = [00000000\ 00000000\ 00000000\ 00000000]$ $A[37] = [xxxxxxxx\ xxxxxx11\ 11111111\ 11111111]$ $A[36] = [11111111\ 11111111\ 11111111\ 11111111]$ $A[39] = [xxxxxxxx\ xxxxxx00\ 00000000\ 00000000]$ $A[38] = [00000000\ 00000000\ 00000000\ 00000000]$ $A[41] = [xxxxxxxx\ xxxxxx11\ 11111111\ 11111111]$ $A[40] = [11111111\ 11111111\ 11111111\ 11111111]$ $A[43] = [xxxxxxxx\ xxxxxx00\ 00000000\ 00000000]$ $A[42] = [00000000\ 00000000\ 00000000\ 00000000]$ $A[45] = [xxxxxxxx\ xxxxxx11\ 11111111\ 11111111]$ $A[44] = [11111111\ 11111111\ 11111111\ 11111111]$ $A[47] = [xxxxxxxx\ xxxxxx00\ 00000000\ 00000000]$ $A[46] = [00000000\ 00000000\ 00000000\ 00000000]$ $A[49] = [xxxxxxxx\ xxxxxx11\ 11111111\ 11111111]$ $A[48] = [11111111\ 11111111\ 11111111\ 11111111]$ $A[51] = [xxxxxxxx\ xxxxxx00\ 00000000\ 00000000]$ $A[50] = [00000000\ 00000000\ 00000000\ 00000000]$ $A[53] = [xxxxxxxx\ xxxxxx11\ 11111111\ 11111111]$ $A[52] = [11111111\ 11111111\ 11111111\ 11111111]$ $A[55] = [xxxxxxxx\ xxxxxx00\ 00000000\ 00000000]$ $A[54] = [00000000\ 00000000\ 00000000\ 00000000]$ $A[57] = [xxxxxxxx\ xxxxxx11\ 11111111\ 11111111]$ $A[56] = [11111111\ 11111111\ 11111111\ 11111111]$ $A[59] = [xxxxxxxx\ xxxxxx00\ 00000000\ 00000000]$ $A[58] = [00000000\ 00000000\ 00000000\ 00000000]$ $A[61] = [xxxxxxxx\ xxxxxx11\ 11111111\ 11111111]$ $A[60] = [11111111\ 11111111\ 11111111\ 11111111]$ $A[63] = [xxxxxxxx\ xxxxxx00\ 00000000\ 00000000]$ $A[62] = [00000000\ 00000000\ 00000000\ 00000000]$ $A[65] = [xxxxxxxx\ xxxxxx00\ 00000000\ 00000000]$ $A[64] = [00000000\ 00000000\ 00000000\ 00000000]$ $A[67] = [xxxxxxxx\ xxxxxx00\ 00000000\ 00000000]$ $A[66] = [00000000\ 00000000\ 00000000\ 00000000]$

⋮

In a third example, the number of pixels of one row X=640, number of pixels of one column Y=512, number of processor data lines L=number of DMD data lines N=64, and processor internal data width W=32. The number of pattern values per group M=X/N=640/64=10. The pattern may be described by Equation (7).

The corresponding element j and bit k of the A[X*Y/W] for each (x,y) may be given by Equations (10):

$$A[1] = [00000000\ 00000000\ 00000000\ 00000000] \quad A[0] = [00000000\ 00000000\ 00000000\ 00000000] \tag{10}$$

$$A[3] = [11111111\ 11111111\ 11111111\ 11111111] \quad A[2] = [11111111\ 11111111\ 11111111\ 11111111]$$

$$A[5] = [00000000\ 00000000\ 00000000\ 00000000] \quad A[4] = [00000000\ 00000000\ 00000000\ 00000000]$$

$$A[7] = [11111111\ 11111111\ 11111111\ 11111111] \quad A[6] = [11111111\ 11111111\ 11111111\ 11111111]$$

$$A[9] = [00000000\ 00000000\ 00000000\ 00000000] \quad A[8] = [00000000\ 00000000\ 00000000\ 00000000]$$

$$A[11] = [11111111\ 11111111\ 11111111\ 11111111] \quad A[10] = [11111111\ 11111111\ 11111111\ 11111111]$$

$$A[13] = [00000000\ 00000000\ 00000000\ 00000000] \quad A[12] = [00000000\ 00000000\ 00000000\ 00000000]$$

-continued

A[15] = [11111111 11111111 11111111 11111111] A[14] = [11111111 11111111 11111111 11111111]

A[17] = [00000000 00000000 00000000 00000000] A[16] = [00000000 00000000 00000000 00000000]

A[19] = [11111111 11111111 11111111 11111111] A[18] = [11111111 11111111 11111111 11111111]

A[21] = [11111111 11111111 11111111 11111111] A[20] = [11111111 11111111 11111111 11111111]

A[23] = [00000000 00000000 00000000 00000000] A[22] = [00000000 00000000 00000000 00000000]

A[25] = [11111111 11111111 11111111 11111111] A[24] = [11111111 11111111 11111111 11111111]

A[27] = [00000000 00000000 00000000 00000000] A[26] = [00000000 00000000 00000000 00000000]

A[29] = [11111111 11111111 11111111 11111111] A[28] = [11111111 11111111 11111111 11111111]

A[31] = [00000000 00000000 00000000 00000000] A[30] = [00000000 00000000 00000000 00000000]

A[33] = [11111111 11111111 11111111 11111111] A[32] = [11111111 11111111 11111111 11111111]

A[35] = [00000000 00000000 00000000 00000000] A[34] = [00000000 00000000 00000000 00000000]

A[37] = [11111111 11111111 11111111 11111111] A[36] = [11111111 11111111 11111111 11111111]

A[39] = [00000000 00000000 00000000 00000000] A[38] = [00000000 00000000 00000000 00000000]

A[41] = [00000000 00000000 00000000 00000000] A[40] = [00000000 00000000 00000000 00000000]

A[43] = [00000000 00000000 00000000 00000000] A[42] = [00000000 00000000 00000000 00000000]

A[45] = [00000000 00000000 00000000 00000000] A[44] = [00000000 00000000 00000000 00000000]

⋮

Data is loaded into DMD 24 at step 114. The data may be loaded from a data array a bus $B_i$ in the following manner:

| | | |
|---|---|---|
| data bus: | $B_{L-1}B_{L-2}$ | $B_1B_0$ |
| data at clock n: | A[1] | A[0] |
| data at clock n + 1: | A[3] | A[2], and so on. |

After loading the data into DMD 24, the method terminates.

If the number of data lines N of DMD 24 is less than data memory width W of processor 20 at step 104, the method proceeds to step 118. A word array is generated at step 118. The word array may be generated in a manner similar to that described with reference to step 108.

A data array is generated at step 122. As an example, a data array comprising A[X*Y/W] may be generated. For a given pixel at location (x,y), the pattern value $Z_{x,y}$=f(x,y) of the pixel corresponds to a bit k of element j of A[X*Y/W], where k and j may be determined by Equations (11) and (12):

$$j=M*y+(M-1-|x|_M) \tag{11}$$

$$k=|[x/M]|_W \tag{12}$$

A data array for a specific pattern may be generated by updating each entry to record the pattern values of the pattern. For example, entries may be updated according to Equations (5) and (6).

Data is loaded into DMD 24 at step 124. The data may be loaded from a data array a bus $B_i$ in the following manner:

| | |
|---|---|
| data bus: | $B_{L-1}$ $B_{L-2}$ . . . $B_1B_0$ |
| data at clock n: | A[0] |
| data at clock n + 1: | A[1] |

-continued

| | |
|---|---|
| data at clock n + 2: | A[2] |
| data at clock n + 3: | A[3], and so on. |

In an example, the number of pixels of one row X=640, number of pixels of one column Y=512, number of processor data lines L=number of DMD data lines N=32, and processor internal data width W=32. The group number of pattern values per group M=X/N=640/32 =20. The pattern may be described by Equation (7).

The corresponding element j and bit k of the A[X*Y/W] for each (x,y) may be given by Equations (13):

A[0] = [00000000 00000000 00000000 00000000] (13)

A[1] = [11111111 11111111 11111111 11111111]

A[2] = [00000000 00000000 00000000 00000000]

A[3] = [11111111 11111111 11111111 11111111]

A[4] = [00000000 00000000 00000000 00000000]

A[5] = [11111111 11111111 11111111 11111111]

A[6] = [00000000 00000000 00000000 00000000]

A[7] = [11111111 11111111 11111111 11111111]

A[8] = [00000000 00000000 00000000 00000000]

A[9] = [11111111 11111111 11111111 11111111]

A[10] = [00000000 00000000 00000000 00000000]

A[11] = [11111111 11111111 11111111 11111111]

A[12] = [00000000 00000000 00000000 00000000]

A[13] = [11111111 11111111 11111111 11111111]

-continued

A[14] = [00000000 00000000 00000000 00000000]

A[15] = [11111111 11111111 11111111 11111111]

A[16] = [00000000 00000000 00000000 00000000]

A[17] = [11111111 11111111 11111111 11111111]

A[18] = [00000000 00000000 00000000 00000000]

A[19] = [11111111 11111111 11111111 11111111]

A[20] = [11111111 11111111 11111111 11111111]

A[21] = [00000000 00000000 00000000 00000000]

A[22] = [11111111 11111111 11111111 11111111]

A[23] = [00000000 00000000 00000000 00000000]

A[24] = [11111111 11111111 11111111 11111111]

A[25] = [00000000 00000000 00000000 00000000]

A[26] = [11111111 11111111 11111111 11111111]

A[27] = [00000000 00000000 00000000 00000000]

A[28] = [11111111 11111111 11111111 11111111]

A[29] = [00000000 00000000 00000000 00000000]

A[30] = [11111111 11111111 11111111 11111111]

A[31] = [00000000 00000000 00000000 00000000]

A[32] = [11111111 11111111 11111111 11111111]

A[33] = [00000000 00000000 00000000 00000000]

A[34] = [11111111 11111111 11111111 11111111]

A[35] = [00000000 00000000 00000000 00000000]

A[36] = [11111111 11111111 11111111 11111111]

A[37] = [00000000 00000000 00000000 00000000]

A[38] = [11111111 11111111 11111111 11111111]

A[39] = [00000000 00000000 00000000 00000000]

A[40] = [00000000 00000000 00000000 00000000]

A[41] = [00000000 00000000 00000000 00000000]

A[42] = [00000000 00000000 00000000 00000000]

⋮

After loading the data into DMD 24, the method terminates.

Alterations or permutations such as modifications, additions, or omissions may be made to the method without departing from the scope of the invention. The method may include more, fewer, or other steps. Additionally, steps may be performed in any suitable order without departing from the scope of the invention.

Certain embodiments of the invention may provide one or more technical advantages. A technical advantage of one embodiment may be that data may be loaded directly from a processor into a DMD. Loading data directly from a processor may be more efficient. Another technical advantage of one embodiment may be that the processor may be programmed to load data by associating a bit of a word in the addressable memory to a pixel of an array of the spatial light modulator. Accordingly, the processor may comprise a commercial off-the-shelf programmable processor rather than a hardware implementation such ASIC or FPGA devices that may require customization.

While this disclosure has been described in terms of certain embodiments and generally associated methods, alterations and permutations of the embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

To aid the Patent Office and any readers of any patent issued on this application in interpreting the claims appended hereto, applicants wish to note that they do not intend any of the appended claims to invoke paragraph 6 of 35 U.S.C. § 112 as it exists on the date of filing hereof unless the words "means for" or "step for" are used in the particular claim.

What is claimed is:

1. A system for loading data to a spatial light modulator, comprising:

a spatial light modulator having an array of pixels, the array having a size of x bits per row and y rows; and one or more processors coupled to the spatial light modulator via data lines, each processor having a programmable processing unit and addressable memory;

wherein the one or more processors are programmed to locate a position in a word of the addressable memory as a function of the (x,y) coordinate values, to repeat the locating steps for a group of binary values, and to deliver the group of binary values to the spatial light modulator; and a number of data lines for transmitting groups of binary values from the processor to the spatial light modulator.

2. The system of claim 1, wherein the spatial light modulator is a digital micromirror device.

3. The system of claim 1, wherein each position in a word is calculated by calculating the kth position in the jth word, where j is a function of x and y and k is a function of x.

4. The system of claim 3, wherein j is further a function of the processor's internal data width.

5. The system of claim 3, wherein j is further a function of the number of pixels in one row of the array divided by the number of data lines.

6. A method of loading data into a spatial light modulator having an (x,y) array of pixels, comprising:

storing binary pixel values in addressable memory of one or more processors;

accessing binary pixel values for (x,y) positions of the pixel array by calculating a position in a word of the addressable memory as a function of (x,y), and retrieving the binary value at that position;

directly loading groups of the binary values to the spatial light modulator via a number of data lines.

7. The method of claim 6, wherein the spatial light modulator is a digital micromirror device.

8. The method of claim 6, wherein each position in a word is calculated by calculating the kth position in the jth word, where j is a function of x and y and k is a function of x.

9. The method of claim 8, wherein j is further a function of the processor's internal data width.

10. The method of claim 8, wherein j is further a function of the number of pixels in one row of the array divided by the number of data lines.

11. The method of claim 8, wherein k is further a function of the number of pixels in one row of the array divided by the number of data lines.

12. The system of claim 8, wherein k is further a function of the number of pixels in one row of the array divided by the number of data lines.

13. A method of mapping binary pixel values of a spatial light modulator pixel array to addressable memory of a processor, comprising the steps of:

expressing pixel values of the array as z(x,y) values; and calculating words of the addressable memory and bit positions within the words, as functions of x and y.

14. The method of claim 13, wherein each z(x,y) value is calculated as the kth position in the jth word, wherein j is a function of x, y, M, and W, and k is a function of x; wherein W is the processor's internal data width of each word; and wherein M is the number of pixels in one row of the array divided by N, N representing the width of a data bus between the processor and the spatial light modulator.

15. A method of reading data from spatial light modulator having an (x,y) array of pixels directly to a processor, comprising:

receiving binary pixel values from the spatial light modulator via a number of data lines; and storing each binary pixel values for an (x,y) position of the pixel array by calculating a position in a word of the addressable memory as a function of (x,y), and storing the binary value at that position.

16. A processor for loading data to a spatial light modulator, comprising:

an addressable memory that stores binary values, each binary value corresponding to a pixel of the spatial light modulator; and processing logic coupled to the addressable memory and operable to directly load binary data for a spatial light modulator's (x,y) array, via a data bus, by:

expressing each (x,y) binary value as corresponding to a bit k in an element j of the memory;

wherein j is a function of x, y, M, and W, and k is a function of x;

wherein W is the processor's internal data width of each element; and wherein M is the number of pixels in one row of the array divided by N, N representing the width of the data bus;

retrieving each binary value from its kth position in a jth memory element; and delivering groups of binary values to the spatial light modulator.

17. A method of using a processor's addressable memory to directly load binary data stored in the addressable memory to a spatial light modulator's (x,y) array, via a number of data lines, comprising the steps of:

expressing each (x,y) binary value as corresponding to a bit k in an element j of the memory;

wherein j is a function of x, y, M, and W;

wherein k is a function of x;

wherein W is the processor's internal data width of each element; and wherein M is the number of elements in one row of the array divided by the number of data lines.

18. The method of claim 17, wherein the width of the data bus is greater than the width of each element but less than or equal to twice the data width of each element.

19. The method of claim 17, wherein:

$W<N\leqq 2W$; $L\geqq N$, L represents the processor's external bus width; X is divisible by N, X representing a total number of rows of the spatial light modulator;

$j=2*M*y+2*(M-1-|x|_M)+[x/(W*M)]$; and $k=|[x/M]|_W$.

20. The method of claim 17, wherein:

$W<N\leqq 2W$; $L\geqq N$, L representing the processor's external bus width; X is divisible by N, X representing a total number of rows of the spatial light modulator;

$j=2*M*y+2*(M-1-|x|_M)+[x/(W*M)]$; and $k=|[x/M]|_W$, and further comprising:

updating k of j to record a pattern value $z_{x,y}$ using a data array A[X*Y/W] and a memory buffer bitMask[k] according to:

A[j]=A[j] & (~bitMask[k]) if $z_{x,y}=0$; and

A[j]=A[j]|bitMask[k] if $z_{x,y}=1$.

21. The method of claim 17, further comprising:

updating k of j to record a pattern value $z_{x,y}$ using a data array A[X*Y/W] and a memory buffer bitMask[k] according to:

A[j]=A[j] & (~bitMask[k]) if $z_{x,y}=0$; and

A[j]=A[j]|bitMask[k] if $z_{x,y}=1$.

22. The method of claim 17, wherein the width of the data bus is less than or equal to the data width of each element.

23. The method of claim 17, wherein:

$N\leqq W$; $L\geqq N$, L representing the processor's external bus width; X is divisible by N, X representing a total number of rows of the spatial light modulator;

$j=M*y+(M-1-|x|_M)$; and $k=|[x/M]|_W$.

24. The method of claim 17, wherein:

$N\leqq 2W$; $L\geqq N$, L representing the processor's external bus width; X is divisible by N, X representing a total number of rows of the spatial light modulator;

$j=M*y+(M-1-|x|_M)$; and $k=|[x/M]|_W$, and further comprising:

updating k of j to record a pattern value $z_{x,y}$ using a data array A[X*Y/W] and a memory buffer bitMask[k] according to:

A[j]=A[j] & (~bitMask[k]) if $z_{x,y}=0$; and

A[j]=A[j]|bitMask[k] if $z_{x,y}=1$.

* * * * *